US005692567A

United States Patent [19]

Doner

[11] Patent Number: 5,692,567

[45] Date of Patent: Dec. 2, 1997

[54] PORTABLE FLUID LIFTING APPARATUS

[76] Inventor: August K. Doner, Road East/West 34 West of 66, P.O. Box 67, Chelsea, Okla. 74016

[21] Appl. No.: 570,075

[22] Filed: Dec. 11, 1995

[51] Int. Cl.[6] ..... E21B 41/00; E21B 43/00

[52] U.S. Cl. ..... 166/369; 166/53; 166/65.1; 166/68.5; 166/69

[58] Field of Search ..... 166/53, 65.1, 68, 166/68.5, 69, 77.4, 162, 369; 198/643

[56] References Cited

U.S. PATENT DOCUMENTS

| | | | |
|---|---|---|---|
| H702 | 11/1989 | Shively et al. | 187/94 |
| 157,135 | 11/1874 | Port . | |
| 294,815 | 3/1884 | Schupp . | |
| 562,967 | 6/1896 | Miles . | |
| 1,117,939 | 11/1914 | Zublin . | |
| 1,937,707 | 12/1933 | McDowell | 166/69 |
| 2,016,793 | 10/1935 | Tveit . | |
| 2,438,298 | 3/1948 | Reed | 166/69 X |
| 3,338,379 | 8/1967 | Patterson . | |
| 3,378,130 | 4/1968 | Wallace . | |
| 3,766,671 | 10/1973 | Guntert . | |
| 3,774,685 | 11/1973 | Rhodes | 166/369 |
| 3,795,305 | 3/1974 | Sandvik . | |
| 3,968,579 | 7/1976 | Rossfelder . | |
| 4,086,035 | 4/1978 | Klaeger, Jr. et al. | 166/53 X |
| 4,202,119 | 5/1980 | Grace . | |
| 4,241,788 | 12/1980 | Brennan | 166/105.5 |
| 4,368,909 | 1/1983 | Alexander, Jr. | 166/68.5 X |
| 4,493,413 | 1/1985 | Harrell . | |
| 4,552,220 | 11/1985 | Jones | 166/369 |
| 4,583,916 | 4/1986 | Senghaas et al. | 166/68.5 X |
| 4,712,667 | 12/1987 | Jackson et al. | 198/643 |
| 4,751,969 | 6/1988 | Klaeger | 166/53 X |
| 4,796,748 | 1/1989 | Manning | 198/711 |
| 4,802,292 | 2/1989 | Masuda | 37/69 |
| 4,927,004 | 5/1990 | Leaton | 198/704 |
| 4,962,847 | 10/1990 | Pisors et al. | 166/369 X |
| 5,054,557 | 10/1991 | Wittrisch | 166/309 |
| 5,058,627 | 10/1991 | Brannen | 138/27 |
| 5,080,781 | 1/1992 | Evins, IV | 166/369 X |
| 5,322,119 | 6/1994 | Kadwell et al. | 166/69 X |

*Primary Examiner*—George A. Suchfield
*Attorney, Agent, or Firm*—McKinney, Stringer & Webster, P.C.

[57] ABSTRACT

A portable oil recovery apparatus especially for use at de-pressurized wells. It is simple and inexpensive to build and to operate. The apparatus is small and lightweight enough so that it can be transported in a pickup truck for easy movement between well sites, and it can be installed by only two people. The apparatus employs a simple pulley system which dips a string of cups repeatedly into the well bore just deep enough to reach the oil and not deep enough to collect any water. Thus, little or no water is mixed with the recovered product, and no tubing or rods are necessary. The pulley system is automatically operated and requires little supervision and maintenance. The dipping cups are generally cylindrical, each having a central longitudinal tube extending therethrough by which the cup is supported on the string. Each cup has a lid with a plurality of depending fingers which extend down into the cup. The lid also has a central opening aligned with the tube in the cup for supporting the lid on the string in alignment with the cup. Leader cones are provided at each end of the string for guiding the travel of the dipping assembly in both directions through the pulley system.

37 Claims, 9 Drawing Sheets

PORTABLE FLUID LIFTING APPARATUS

FIELD OF THE INVENTION

The present invention relates generally to devices for lifting liquid from a column of liquid in an underground well bore and, more particularly, to portable devices for recovering oil from a non-pressurized well.

SUMMARY OF THE INVENTION

The present invention is directed to a portable apparatus for lifting liquid from a column of liquid in an underground well bore which opens above ground at a well head. The apparatus comprises a frame adapted to support the apparatus over the well head. A pulley system is supported on the frame. The pulley system comprises a spool and a guide wheel supported proximate to the spool.

A dipping string is included in the pulley system. One end of the dipping string is attached to the spool of the pulley system and a weight is attached to the free end. A portion of the dipping string therebetween is supported over the guide wheel. The length of the dipping string is sufficient to extend from the spool, over the guide wheel and down into the column of liquid when the apparatus is positioned over the well head.

A dipping assembly is supported on the dipping string of the pulley system. The dipping assembly comprises at least one dipping cup having a closed lower end and an open upper end. The dipping cups are axially supported on the dipping string near the free end above the weight. The spool, the guide wheel and the dipping assembly are arranged so that dipping cups are inverted as the dipping cups are pulled over the guide wheel toward the spool and so that the dipping cups are returned to an upright position as the dipping cups are pulled over the guide wheel toward the well bore. Liquid spilling from the inverted dipping cups is collected in a collection chamber generally beneath the pulley system, and this liquid can be drained from the apparatus by a discharge port extending from the collection chamber.

A motorized drive assembly is included in the apparatus to turn the spool of the pulley system for retracting the dipping string. When the dipping string is fully retracted, the motor may be deactivated so that the spool is released, allowing the weight to pull the string back down into the well bore for another "dip." Alternatively, the motor may operate in a reverse direction, thereby lowering the dipping string down into the well bore at a controlled speed. An electrical system is provided in the apparatus to permit automatic operation of the apparatus.

In another aspect, the present invention is directed to a portable apparatus for recovering oil from a non-pressurized well comprising a well bore opening above ground at a well head. In this aspect, the apparatus comprises a pulley system including a spool and a guide wheel supported proximate to the spool. One end of the dipping string is attached to the spool of the pulley system, and a weight is attached to the free end. The portion of the string therebetween is supported over the guide wheel. The length of the dipping string is sufficient to extend from the spool, over the guide wheel, and down into the column of liquid when the apparatus is positioned over the well head. The pulley assembly is mounted on a frame supported by a plurality of independently adjustable legs.

A dipping assembly is supported on the dipping string of the pulley system near the free end. The dipping assembly comprises a plurality of dipping cups, each such dipping cup having a closed lower end and an open upper end and being axially supported on the dipping string near the free end. The spool, the guide wheel, the dipping string and the dipping assembly are arranged so that the dipping cups are inverted as they are pulled over the guide wheel toward the spool and so that the dipping cups are returned to an upright position as they are pulled over the guide wheel toward the well head. As the oil spills out of the inverted dipping cups, it is received in a collection chamber generally beneath the pulley system. A discharge port extends from the collection chamber for draining oil therefrom.

A motorized drive assembly is included in the apparatus to turn the spool of the pulley system for retracting the dipping string. When the dipping string is fully retracted, the motor may be deactivated so that the spool is released, allowing the weight to pull the string back down into the well bore for another "dip." Alternatively, the motor may operate in a reverse direction, thereby lowering the dipping string down into the well bore at a controlled spell. An electrical system is provided in the apparatus to permit automatic operation of the apparatus.

In yet another aspect, the present invention comprises a dipping cup. The dipping cup has a body with a closed lower end, an open upper end, and a generally cylindrical side wall with an inner surface, the inner surface defining a liquid-receiving space inside the body. An axial tube extends up through the body.

The dipping cup further includes a lid sized to cover the open upper end of the body. The lid has a central opening therein aligned with the axial tube in the body, and at least one opening therein which communicates with the liquid-receiving space in the body. The lid has a peripheral flange sized to extend slightly beyond the body when the lid is positioned over the open upper end thereof. Fingers depend from the lid near the peripheral flange, the fingers being sized to extend down into the body. The fingers are positioned on the lid so that when the lid is positioned over the open upper end of the body the fingers are adjacent the inner surface of the side wall of the body. In this way, axial and lateral alignment of the lid with the body is maintained.

Still further, the present invention includes a method for recovering oil from a column of oil in the well bore of a non-pressurized well. In accordance with this method, a dipping assembly is repeatedly and automatically extended and retracted directly into and out of the column of oil in the well bore from a position over the well bore. This is carried out without the use of a sucker rod or tubing string. The dipping assembly comprises a plurality of dipping cups axially supported on a dipping string. In each cycle, after retracting the plurality of dipping cups out of the well bore and before extending the plurality of dipping cups into the well bore, oil is collected from the dipping cups by inverting the dipping cups over a collection chamber.

BRIEF DESCRIPTION OF THE DRAWINGS

FIG. 9 is an electrical schematic demonstrating use of a single phase motor in accordance with the present invention.

DETAILED DESCRIPTION OF THE PREFERRED EMBODIMENT

In the recovery of oil from an oil well, the initial production is driven by pressure naturally present underground, usually from water or gas present in the formation. When this natural pressure is exhausted, the oil must be pumped out of the de-pressurized or "stripper" well. Typically, this pumping is carried out by equipment installed at the well head, usually including rods and tubing, pump jacks, and sucker rod pumps. This sort of pump assembly includes a pumping component at the bottom of the well bore. Because in most formations the oil is mixed with water, usually salt water, the oil in the well bore is a column floating on a column of water. Thus, these bottom hole pumping assemblies produce oil mixed with a large amount of water.

Although these bottom hole pumping assemblies are effective, the costs associated with the use of such systems are great. Due to the size and complexity of the equipment involved, the bottom hole pumping system is expensive to install and to operate and has relatively high power demands. In addition, the production fluid must be further processed to separate the salt water from the oil, and then the salt water must be safely disposed of, usually by injecting it into a separate disposal well. In many cases, the cost of recovering oil from a particular well by this kind of system is so close to the market value of the oil that further production from such a well is not economically feasible.

The apparatus of the present invention provides an alternative to the conventional bottom hole pumping systems. The oil recovery apparatus of this invention utilizes a string of dipping cups operated by a simple pulley system. The cups are let down into the well bore only deep enough to collect oil, and then the string is lifted to the surface and the cups are emptied. No tubing or rods are required. The pulley system is housed in a small unit positioned over the well head. The pulley system is driven by a small motor with minimum power requirements.

Thus, the entire apparatus is simple and inexpensive to build and to operate. The unit itself is so small and lightweight that the entire unit can be carried in the back of a pickup truck and can be moved and installed by only two people. These and other advantages will become apparent from the following description of the preferred embodiment of the present invention.

Figure 1:
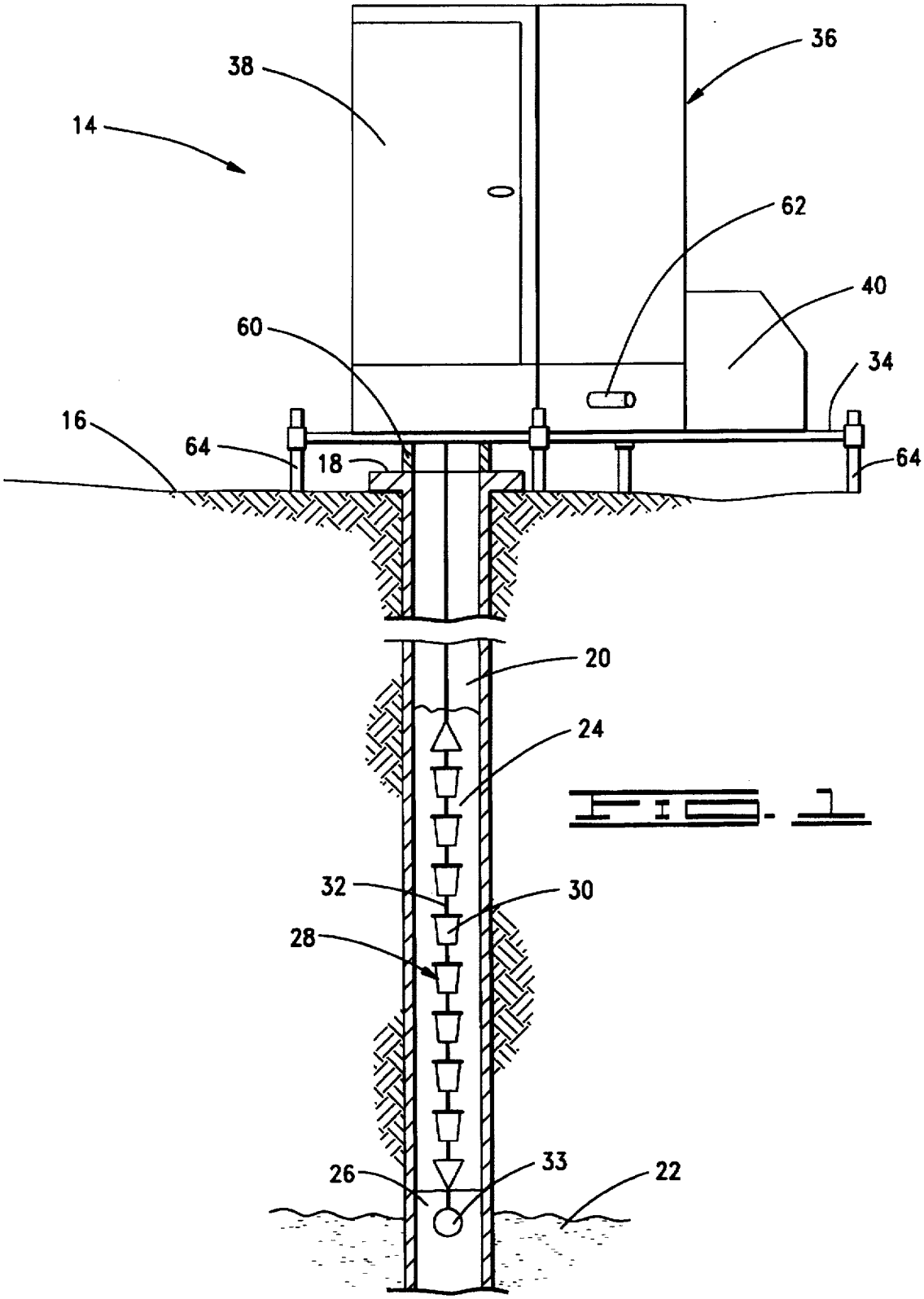
FIG. 1 is a side elevational view of an oil recovery apparatus in accordance with the present invention. The apparatus is positioned over a well head with the dipping assembly suspended in the well bore.

Turning now to the drawings in general, and to FIG. 1 in particular, shown therein is an apparatus constructed in accordance with the present invention designated generally by reference numeral 14. The apparatus 14 is shown positioned on the ground 16 over the well head 18 of a vertical well bore 20. The web bore 20 extends into a reservoir 22 in an underground formation. Oil and water from the reservoir are shown in the well bore, the oil 24 is floating in a column over a column of water 26. Although the apparatus 14 is shown installed at an oil well, it will be appreciated that the invention could be employed with equal success to recover water or some other liquid from an underground well. Further, although the invention is specially suited for use at stripper wells, it will be understood that the invention would be equally useful for recovering liquid from any non-pressurized well.

As shown in FIG. 1, the apparatus generally comprises a dipping assembly 28 which comprises a plurality of dipping cups, one of which is designated by reference numeral 30. The dipping assembly 28 is supported near the free end of a dipping string 32 which is part of a pulley system, yet to be described. A weight 33 is attached to the free end for providing tension in the dipping string 32. The dipping assembly 28 shown in FIG. 1 is enlarged relative to the pulley system for illustrative purposes only. The pulley system is supported on a frame 34 and is enclosed by a housing 36. Access to the pulley system is provided by a door 38 in the housing. A motorized drive assembly, described below, is also supported on the frame 34, and is protected by a removable cover 40.

Figure 2:
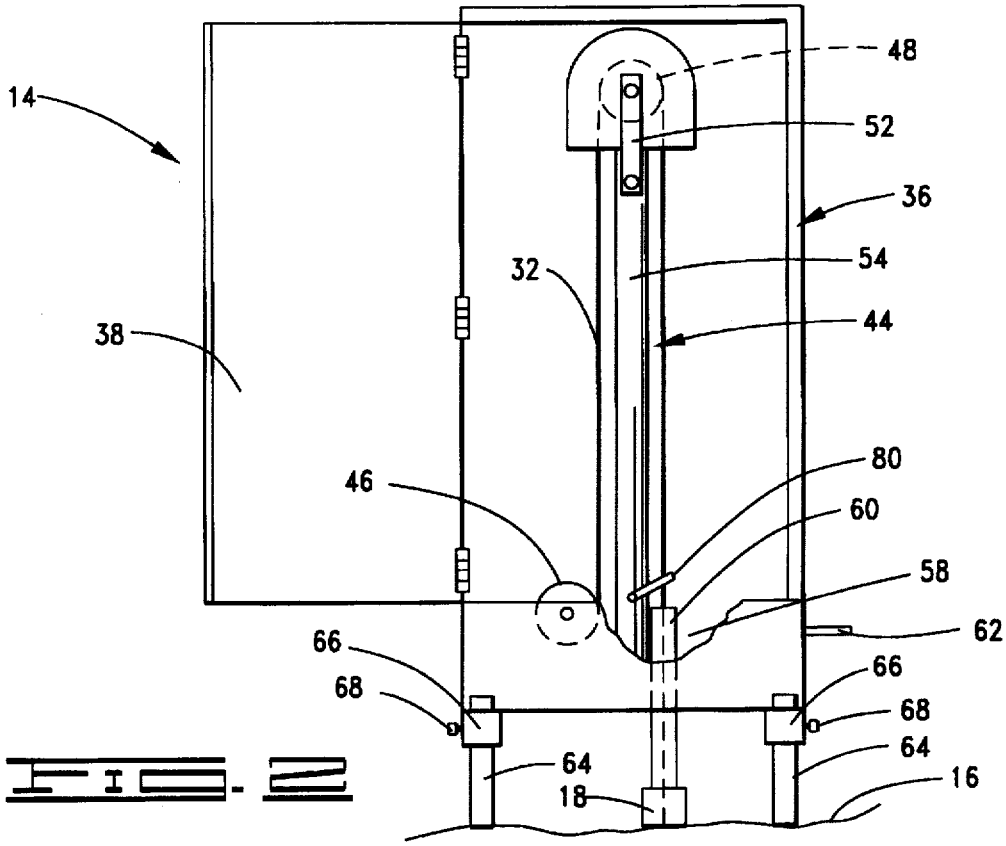
FIG. 2 is a front elevational view of the housing of the oil recovery apparatus shown in FIG. 1. The door of the housing is open showing the pulley system of the dipping assembly.
Figure 3:
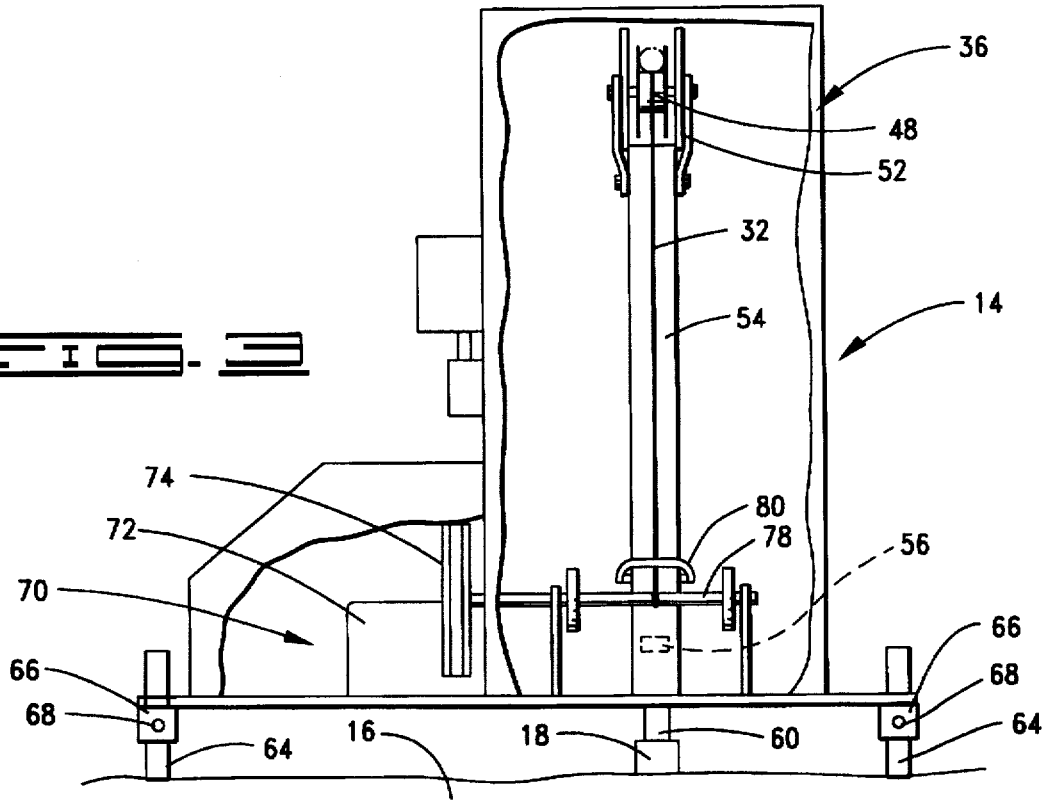
FIG. 3 is a side elevational view of the housing shown in FIG. 2 with the side wall of the housing cut away to show the side of the pulley system.

With reference now to FIGS. 2 and 3, the pulley system will be described. The pulley system 44 comprises a take up spool 46 securely supported on the frame 34. The upper end of the dipping string 32 is attached to the spool 46, as best seen in FIG. 3.

The pulley system 44 further comprises a guide wheel 48 supported adjacent and a distance above the spool 46. The wheel 48 is supported by arms 52, or some suitable means, on the top of a post 54 which is mounted on the frame 34.

In the preferred embodiment, the guide wheel 48 is a rotating member with a circumferential groove therein for receiving the dipping cups 30 as they are pulled therethrough towards the spool 46. The circumferential groove is of sufficient size to constrain the lateral movement of the dipping cups 30 when they travel over the guide wheel 48.

When the spool 46 and the guide wheel 48 are thus arranged, a portion of the dipping string 32 between the spool 46 and the dipping assembly 28 is supported over the guide wheel 48. Now it will be appreciated that the length of the dipping string 32 should be sufficient to extend from the end attached to the spool 46, over the guide wheel 48 and a distance into the well bore sufficient to submerge the dipping cups 30 in the column of oil 24, but it should not be so long that the dipping cups reach the column of water 26.

Now it will be seen also that as the dipping cups 30 are pulled up out of the well bore 20, they will be upright and filled with oil. Then, as the cups 30 are pulled over the guide wheel 48, the dipping cups 30 are inverted, spilling their contents into the bottom of the housing 36. The process is reversed when the string is released or extended; as the cups 30 are pulled back over the guide wheel 48 toward the well bore 20, the cups 30 are returned to the upright position.

The bottom portion of the housing 36 conveniently forms a collection chamber 58 for the recovered oil spilling from the inverted dipping cups 30. A cylindrical collar 60 extends through the bottom of the housing 36, to form an opening therethrough. The cylindrical collar 60 provides a guided path for the dipping assembly 28 (FIG. 1), and will allow the string 32 and the dipping assembly 28 to pass through the collection chamber 58. Oil collected in the collection chamber 58 can be drained therefrom by providing a discharge port 62 on the side of the housing 36.

Referring still to FIGS. 1 through 3, it will now be understood that the dipping string 32, with the dipping cups 30 attached, should be plumb. For this reason, the frame 34 is supported on a plurality of independently adjustable supports or legs which are collectively designated by reference numeral 64. In this way, the level of the frame 34 and thereby the plumb of the dipping string 32 can be adjusted. Although various mechanisms will be equivalent, the embodiment illustrated employs a simple support collar 66 and set screw 68 (FIGS. 2 and 3) to adjustably engage each of the legs 64.

Figure 4:
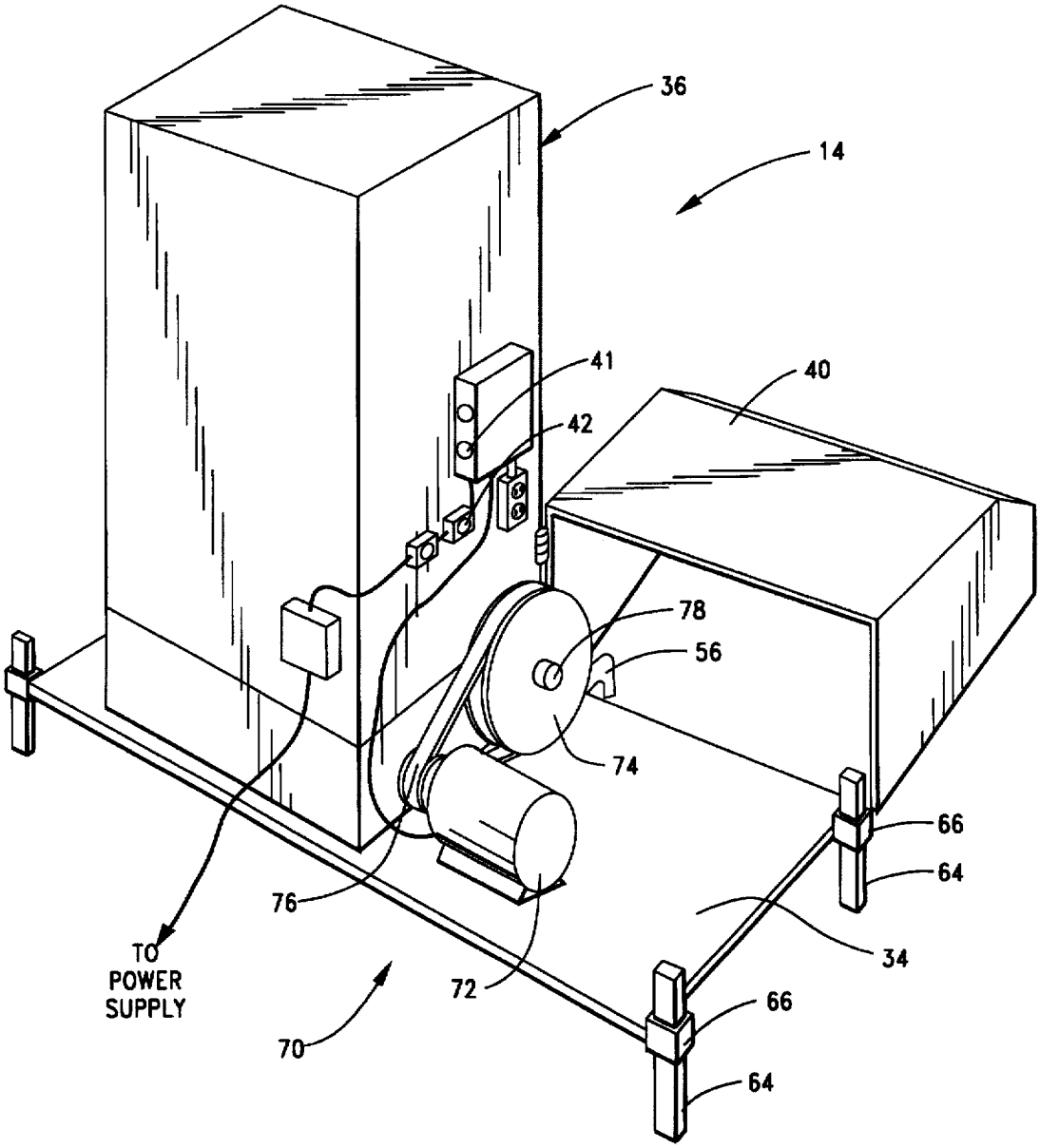
FIG. 4 is a rear perspective view of the housing shown in FIG. 2. The motor cover is open to show the belt drive for the pulley system.

For turning the spool 46, the apparatus 14 is provided with a motorized drive assembly 70, as illustrated in FIGS. 3 and 4. In the preferred embodiment, the drive assembly 70 comprises a motor 72 which rotates a wheel 74 by means of a belt 76. The wheel 74 is fixed on a spindle 78 on which the spool 46 of the pulley system 44 is supported. Thus, the torque of the motor 72 is transmitted to the spool 46 of the pulley system 44.

Returning to FIGS. 2 and 3, the spool 46 and drive assembly 70 preferably are arranged to rotate the spool 46 in one direction, that is, for retracting the string 32 and pulling the dipping assembly 28 (FIG. 1) up into the housing 36 toward the spool 46. To stop rotation of the spool 46 as the dipping assembly 28 approaches the spool, nearing the end of its travel, a limit switch 80 of some sort can be provided on the post 54. The limit switch 80 is positioned to be triggered, by the first of the dipping cups 30 passing it as the dipping assembly 28 emerges from the cylindrical collar 60 and is pulled toward the guide wheel 48. When the limit switch 80 is triggered, thereby opening the normally closed position, the motor 72 will shut off, after a short delay. When the dipping assembly 28 is later lowered back into the well bore 20, the dipping cups 30 again trigger the limit switch 80, and the limit switch 80 is reset to its normally closed position.

Once the limit switch 80 has been triggered, the motor 72 will either disengage or reverse, depending on its configuration. For either configuration, the spool 46 can be rotated in the reverse direction. If the motor 72 is disengaged, the reverse movement of the dipping assembly 28, the dipping string 32, and thus the spool 46, is driven by gravity created by the weight 33 on the free end of the string 32. If the motor 72 reverses, the gravitational pull of the weight 33 on the free end of the string 32 will pull the dipping assembly 28 down into the well bore 20, thereby spinning the spool 46. However, the motor 72 will assist this process by spinning the spool 46 in a reversed direction and at a specified speed. Thus, if the motor 72 reverses, as opposed to merely disengaging, the lowering of the dipping assembly 28 and the reversal of the spool 46 is controlled and effective.

Figure 12:
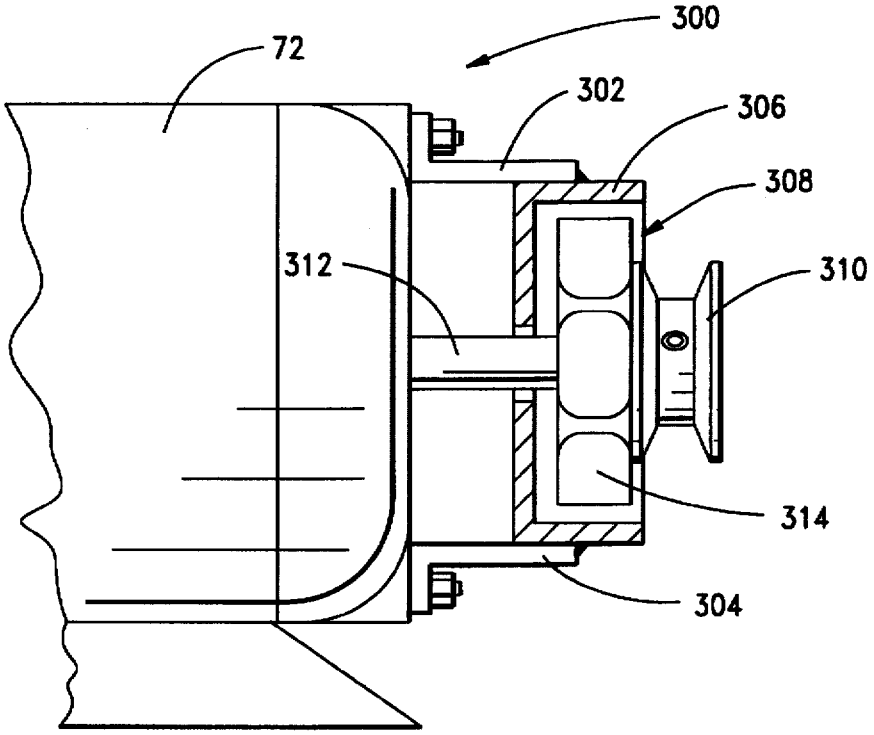
FIG. 12 is a side view of the clutch assembly in accordance with one embodiment of the present invention.
Figure 13:
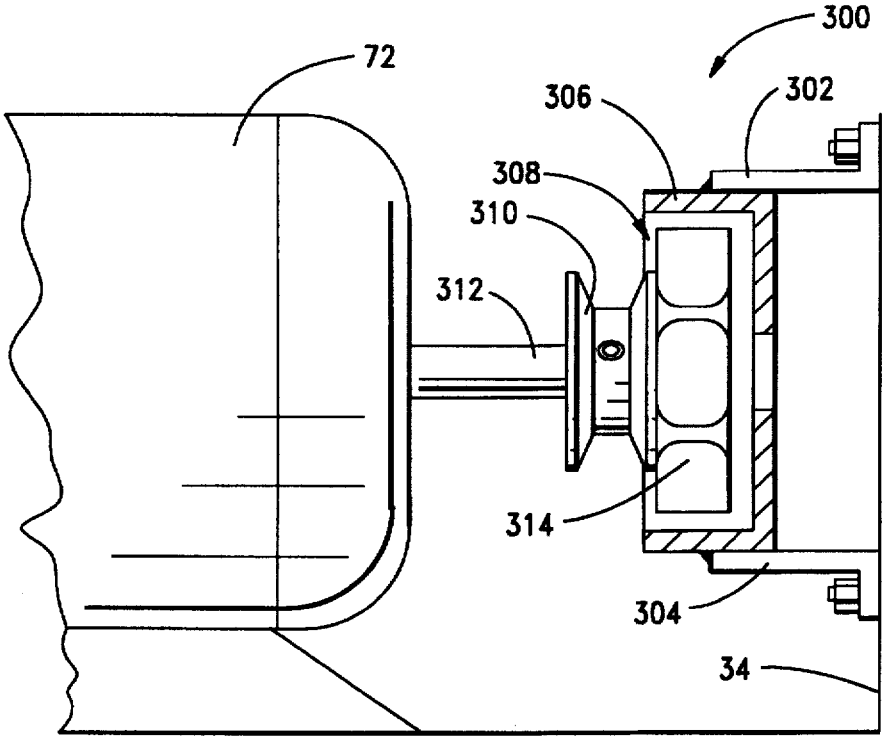
FIG. 13 is a side view of the clutch assembly in accordance with a second embodiment of the present invention.

Preferably, a centrifugal clutch assembly 300 (FIGS. 12–13) is attached to the motor 72 to operate on the dipping string 32, thereby limiting the dropping speed of the dipping assembly 28. The clutch assembly 300 will engage either if the motor 72 is configured to disengage after the dipping string 32 is fully retracted, thereby effecting a reversal of the spool 46, or if the motor 72 fails, thereby causing the dipping string 32 to be pulled into the well bore 20 (FIG. 1) at an excessive speed.

The clutch assembly 300 has an outer drum 306 which is mounted by brackets 302 and 304 or some appropriate method, in an appropriate position, such as to the motor 72 housing or to the apparatus frame 34. The clutch 308 is mounted on the shaft 312 and to the pulley 310 so that the clutch 308 rotates with the shaft 312 and pulley 310. Springs 314 in the clutch 308 engage when the shaft speed is 200–400 revolutions per minute (RPM) above the motor's 72 operational speed, thereby limiting the dropping speed of the dipping assembly 28. Since the motor 72 will likely operate at approximately 1725 RPM, the clutch 308 would engage at about 2000 RPM.

The clutch assembly 300 provides a safety mechanism to the system. For example, if the dipping string 32 is falling free, the clutch assembly 300 will engage and prevent the dipping string 32 from backlashing and getting tangled. Also, when the dipping string 32 is lowered at a controlled speed, such as 1725 RPM, it cuts through the oil easily. However, when the dipping string 32 is lowered at speeds in excess of 2000 RPM, it will hit the surface of the oil, but not initially cut through the oil. This may cause the dipping string 32 to become knotted as it falls to the surface of the oil. Such a knot may eventually hit the limit switch 80 or hang up on the guide wheel 48.

In addition, engaging the clutch assembly 300 provides safety measures related to a single phase motor. A single phase motor has a single throw. A throw is a centrifugal weight, made from a capacitor, which alternates the "push" on the motor magnets. This "push" forces the magnets to go one direction or another, causing the motor to drive. When the motor spins too fast, a throw may be damaged.

The limit switch 80 is electrically connected to the electrical system described hereafter. The motor 72 may be powered by a battery, a generator, by direct current, or by any other suitable power source. A timer in the electrical system can be set to restart the motor 72 after a selected interval and thus repeat the cycle.

The timer element is advantageous because, if there is a power failure or system failure, the machine cycle may be restarted without further action. The timer will preferably be set for ten minutes or longer, allowing the dipping cups 30 to travel to the bottom of the well bore 20 before the motor 72 can recycle and retract the dipping assembly 28.

As previously indicated, the drive assembly 70 is protected by a removable cover 40. For safety, a switching mechanism is provided in the electrical system, described later, which will automatically deactivate the motor when the cover 40 is removed.

Figure 5:
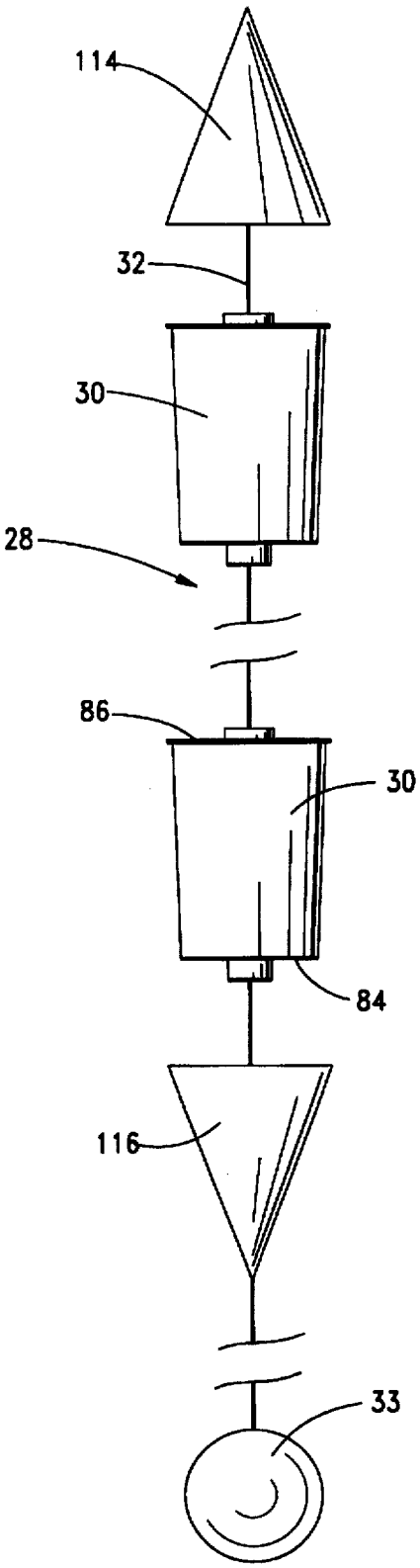
FIG. 5 is a side elevational view of the dipping assembly of the oil recovery apparatus shown in FIG. 1.
Figure 6:
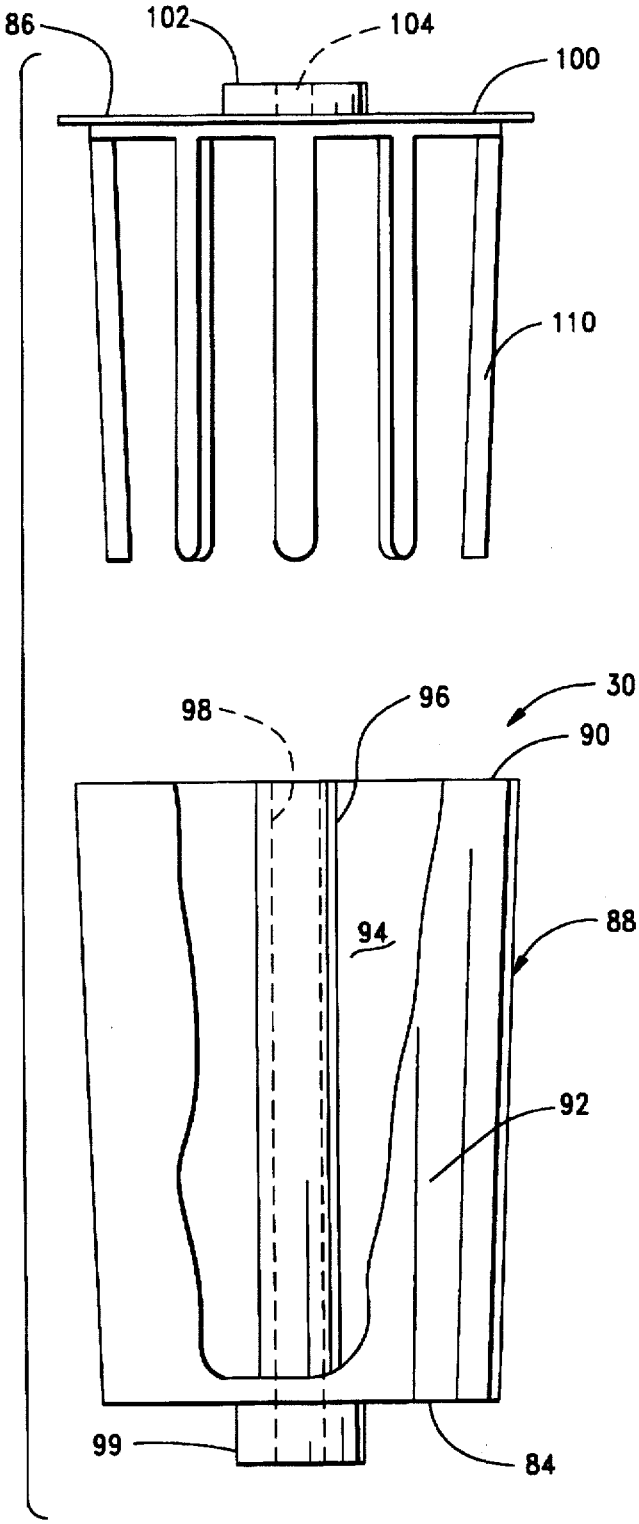
FIG. 6 is a side elevational, exploded and partially fragmented view of one of the dipping cups of the dipping assembly shown in FIG. 5.

Turning now to FIGS. 5 through 8, the preferred dipping assembly 28 will be described. As previously indicated, the dipping assembly 28 comprises at least one and preferably a plurality of dipping cups 30. As best seen in FIG. 5, each dipping cup 30 is axially supported on the dipping string 32 near the free end of the string. Each of the dipping cups 30 is adapted to contain liquid and therefore comprises a closed lower end 84 and an open upper end 86.

More preferably, a dipping cup 30 comprises a body 88 having a closed bottom forming the closed lower end 84 of the cup 30. The body 88 has an open upper end 90 and a generally cylindrical side wall 92. The inner surface of the side wall 92 defines a liquid-receiving space 94 for containing the oil or other liquid recovered by the apparatus 14. An axial tube 96 extends a distance up from the closed lower end 84 inside the body 88, and preferably extends the entire length of the body. The lumen 98 of the tube 96 is sized to receive the string 32. The body may be provided with a boss 99 on the closed lower end 84.

Figure 7:
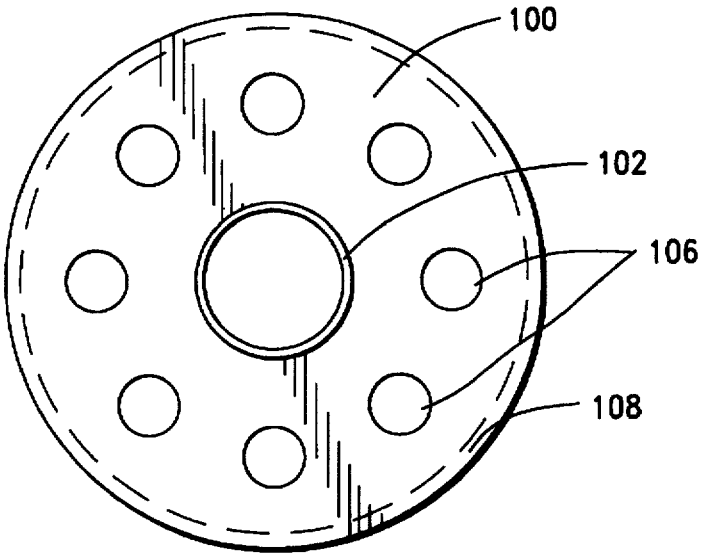
FIG. 7 is a plan view of the lid of the dipping cup shown in FIG. 6.

The dipping cup 30 also preferably comprises a lid 100 which, of course, is sized to cover the open upper end 90 of the body 88. The lid has an opening preferably defined by a boss 102 having a lumen 104 sized similarly to, and aligned with, the lumen 98 of the tube 96 in the body 88. Further, as shown in FIG. 7, the lid 100 is provided with an opening 106 communicating with the liquid-receiving space 94 in the body 88 for allowing oil (or liquid) to collect in the receiving space when the cup 30 is immersed in the column of oil 24. More preferably, the lid 100 has a plurality of openings 106 therein evenly spaced about the boss 102.

The lid 100 is generally flat and has a diameter slightly greater than the diameter of the body 88. Thus, the peripheral edge of the lid 100 will form a flange 108 which extends slightly beyond the body 88 when the lid is positioned over the open upper end 90 of the body. The flange 108 will be deflected by any irregularities in the well bore or casing.

Depending from the underside of the lid 100 is a plurality of fingers 110. The fingers 110 are positioned on the lid 100 so that when the lid 100 is positioned over the open upper end 90 of the body 88, the fingers 110 will be adjacent the inner surface of the side wall 92. Most preferably the fingers 110 extend about half the length of the body 88 and are spaced evenly around the lid 100 near the flange 108. In this way, the lateral and axial alignment of the lid is maintained by the fingers impinging on the side wall 92 of the body 88. Thus, even if the lid 100 becomes dislodged during operation of the apparatus 14, the fingers 110 will guide the lid 100 back into position over the body 88.

Figure 8:
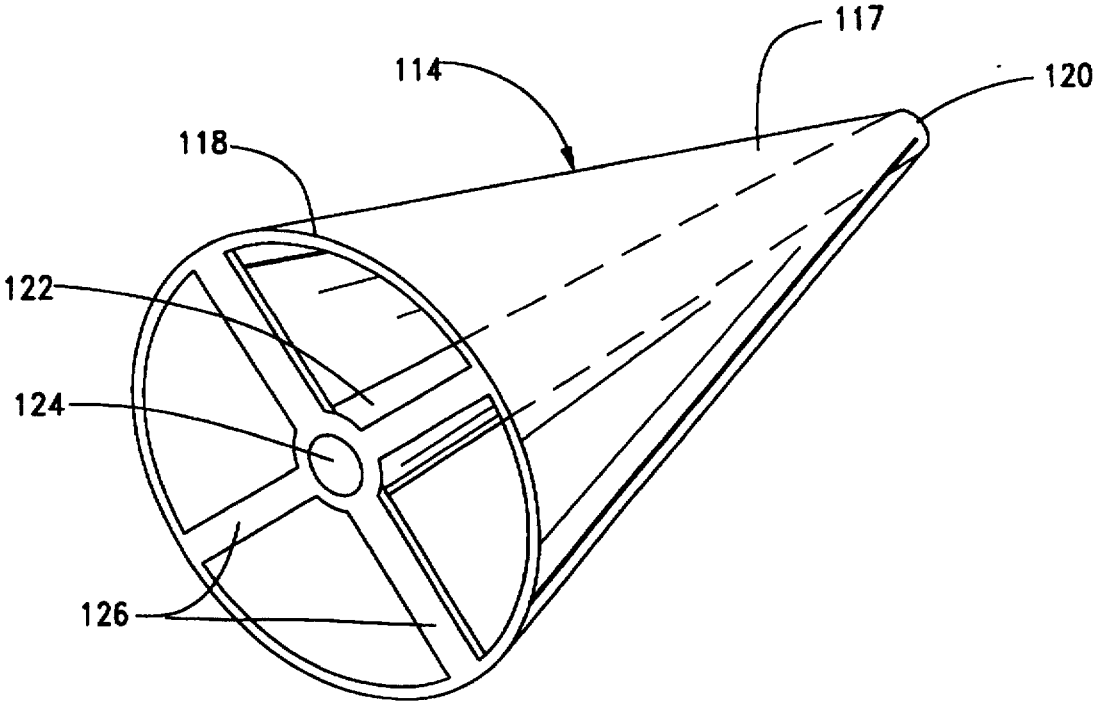
FIG. 8 is a bottom perspective view of one of the leader cones of the dipping assembly shown in FIG. 5.
Figure 3:
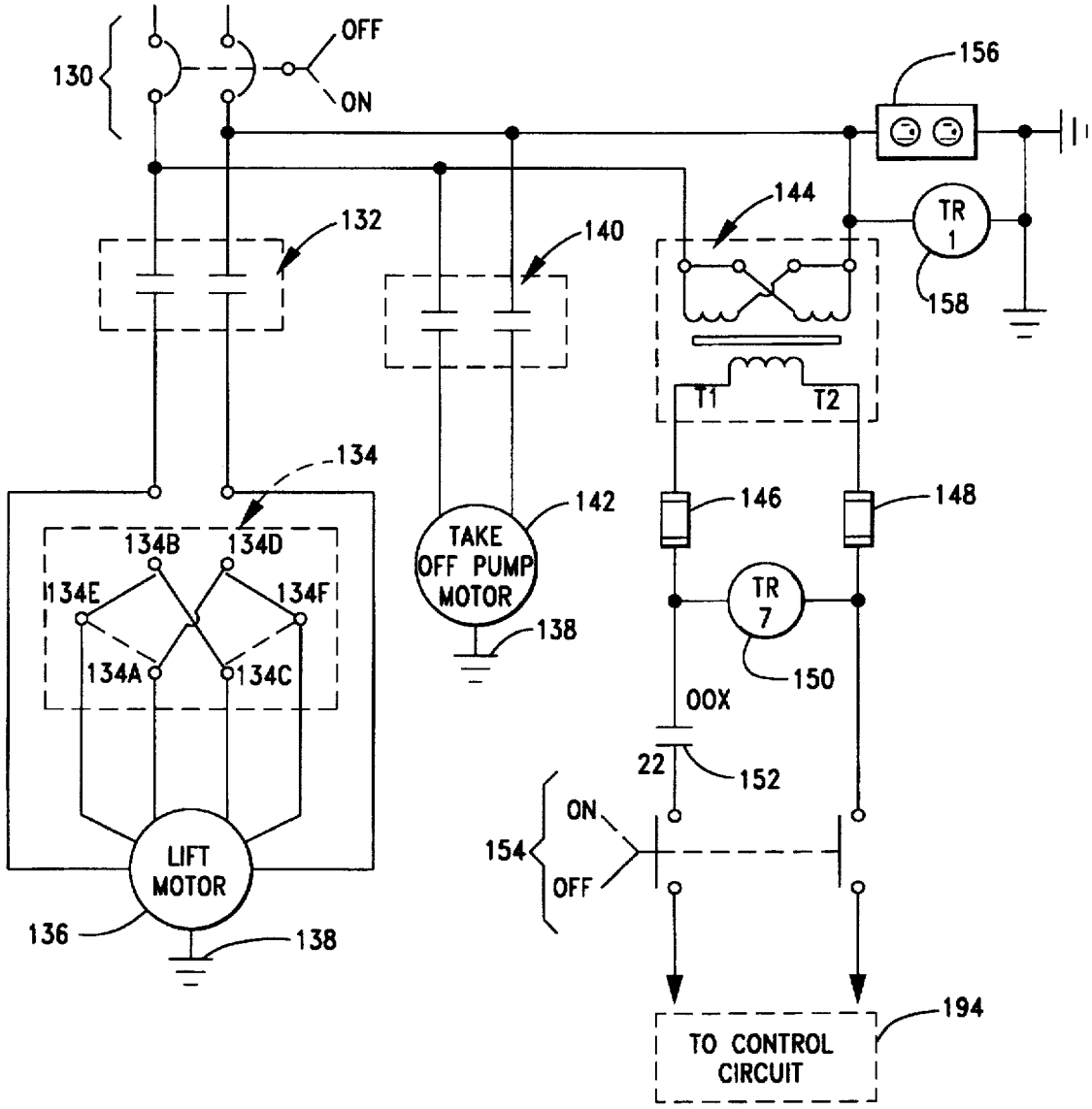

With continuing reference to FIGS. 5 and 8, the dipping assembly 28 preferably further comprises leader cones 114 and 116 at each end of the dipping assembly 28 which are axially supported on the dipping string 32. The leader cones 114 and 116 are similarly formed, so only the cone 114 will be described. The cone 114 comprises a hollow, conically shaped body 117 with a broad base 118 and a narrow tip 120. An axial tube 122 is formed inside the cone 114, the lumen 124 of the axial tube 122 being sized to receive the dipping string 32. To reinforce the strength of the cone 114 and to stabilize the tube 122, webs 126 may be formed between the tube 122 and the inner surface of the body 117.

Now it will be appreciated that because the cones 114 and 116 have narrow tips 120, they facilitate movement of the dipping assembly 28. As the dipping assembly 28 begins its travel from the guide wheel 48 towards the well bore 20, the leader cone 116 facilitates movement of the assembly into the cylindrical collar 60 at the bottom of the housing 36 and then into the well head 18. As the dipping assembly travels back up the well bore 20, the leader cone 114 guides the dipping assembly 28 onto the guide wheel 48.

The dipping cups 30 and leader cones 114 and 116 preferably are formed of a flexible, durable, water proof material, such as a thermoplastic rubber or an elastomer. More preferably, the body 88 and the lid 100, as well as the leader cones 114 and 116, are integrally formed by molding. The dipping string 32 may be made of polypropylene rope.

Figure 10:
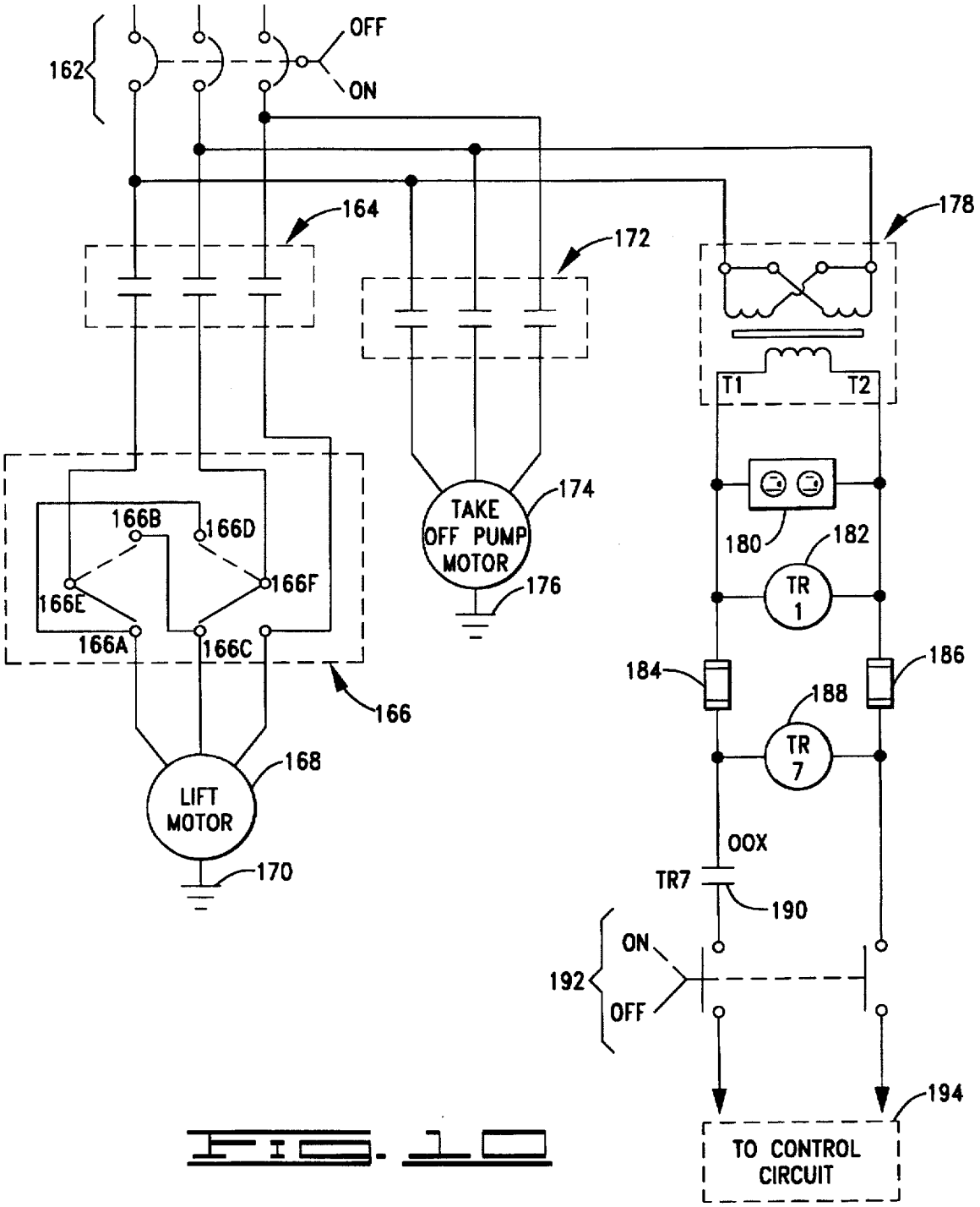
FIG. 10 is an electrical schematic demonstrating use of a three phase motor in accordance with the present invention.
Figure 11:
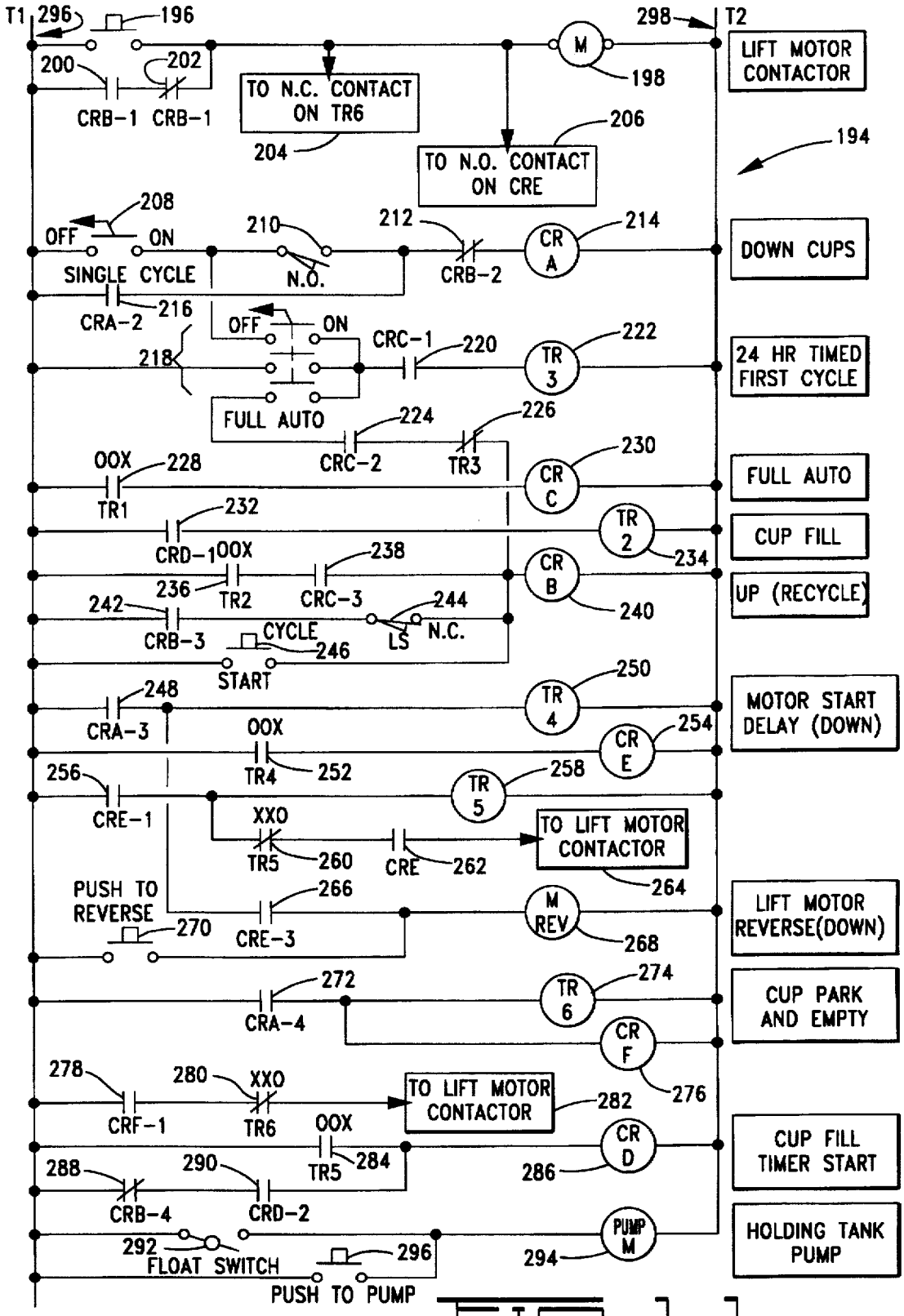
FIG. 11 is a circuit diagram of the electrical system of the oil recovery apparatus shown in FIG. 1.

FIGS. 9 through 11 depict the preferred embodiments of the electrical system. It will, however, be appreciated that the electrical system of the present invention may be implemented in many forms and with differing components and should not be construed as limited to the implementation as set forth herein.

The electrical control system (FIG. 11) may operate with either a single phase, 220 volt, 60 hertz motor (FIG. 9) or a three phase, 220–440 volt, 60 hertz motor (FIG. 10). The alternate motor embodiments provide the system with greater flexibility. Such flexibility is needed since multiple power sources may exist at different well sites. For example, one well site may only have a 220 volt power source, while a different well site may have only a 440 volt power source. The ability to have either a three phase motor or a single phase motor mounted on the system allows the system to adapt to multiple site requirements.

The single phase electrical system of FIG. 9 links to a voltage source (not shown) such as a generator or power line through a thirty-amp circuit breaker 130. In connection with the voltage source, through the circuit breaker 130, are the lift motor contractors 132, which are normally open, and a lift motor 136, which is grounded 138. The lift motor 136 engages when the lift motor contractors 132 are closed.

The lift motor has four associated lift motor contractors 134A, 134B, 134C, and 134D. The hardwired nodes 134E and 134F switch their contacts between the lift motor contactors when a change in direction is required. This switch effects a physical wire change. When the lift motor is moving in the forward direction, the wires are connected so that the nodes 134E and 134F are connected to the forward lift motor contactors 134B and 134D, respectively. Conversely, when the motor is to travel in reverse, the nodes 134E and 134F are connected to the reverse lift motor contactors 134A and 134C, respectively.

Also in connection with the voltage source, through the circuit breaker 130, are the take off pump contactors 140, which are normally open, and a take off pump motor 142, which is grounded 138. When the take off pump contactors 140 close, the take off pump motor 142 engages.

In addition, the system has a two-amp (2 A) maximum load ground fault interrupt (GFI) duplex receptacle 156 and a twenty-four hour TR1 timer 158. The GFI 156 and TR1 timer 158 are grounded 160 at one common node and are connected to the circuit breaker 130 at the other common node.

The GFI 156 allows the system operator to connect conventional equipment to the power source for use at the well site. The twenty-four TR1 timer 158 allows an operator to program the system to operate at specified parameters during a twenty-four hour period. Because power is always on the TR1 timer 158 when the circuit is closed, and because the TR1 timer 158 is programmable, it may be set to initiate independent activities at fifteen minute intervals. When the TR1 timer 158 reaches a specified preset, contacts within the circuit close and provides power to designated circuit elements. Thus, at specified times during each day, the TR1 timer 158 may be set to engage a predetermined activity. For example, the system may disengage a motor in the evening when the TR1 timer 158 reaches its set point.

Each timer has at least one corresponding timer contact. Each of these timer contacts is designated with a three character code on the drawing figures (FIGS. 9–11). This provides a description of the type of contact and its function. For example, the TR7 contact 152 is designated as "OOX." The designation describes the contact as "off, off, and on" or "open, open, and closed." Thus, the contact is open when the power to the circuit is off, open when the power to the circuit is on and the timer has not timed out to its preset, and closed when the power to the circuit is on and the timer has timed out to its preset.

Of most importance is the transformer 144 leading to the control circuit 194 (FIG. 11). The 200 volt-amp transformer 144, which is connected to the voltage source, shares one common node with the TR1 timer 158 and the GFI 156 connection and one of each motor contactor 132 and 140 and another common node with the other set of motor contactors 132 and 140. The transformer 144 operates to transform the incoming voltage to a 110 volt output. Two lines, designated herein as T1 and T2 for clarity, ultimately carry the transformed voltage to the control circuit 194. Both the T1 and T2 lines have two two-set fuses 146 and 148 of appropriate amperage, with the preferred fuse being 15 amps. Connected across the T1 and T2 lines is a TR7 reset timer 150.

The preferred TR7 reset timer 150 is a solid state square timer that will engage the control system and ultimately the lift motor 136 after it times out. It is used to restart the system after a predetermined period, such as ten minutes. Such an event could occur after a power failure. Thus, the TR7 reset timer 150 acts as a delay before the system is restarted.

When power is restored to the system after an outage, the TR7 reset timer 150 times out a specified number of minutes and engages a TR7 contact 152. The TR7 contact is connected between the T1 fuse 146 and the TR7 reset timer 150 node and a double pole, single throw power toggle switch 154. Closing the TR7 contact 152 ultimately allows power to travel through the toggle switch 154, when closed, to the control circuit 194.

Like the single phase motor of FIG. 9, the three phase motor of FIG. 10 connects to the control circuit 194 of FIG. 11. The three phase motor circuit connects to a suitable voltage source (not shown) through a thirty-amp circuit breaker 162. Because the motor is three phase, it can accept voltage inputs of 220 volts and 440 volts. This versatility allows the system to be used at various sites without attempting to transform the line voltage to a more usable form.

The combination of the lift motor contactor 164, the lift motor reversing contactor 166, and the grounded 170 lift motor 168 is connected to the voltage source through the circuit breaker 162. The lift motor 168 is engaged when the lift motor contactor 164 is engaged. In the normal mode, the lift motor 168 runs in the forward direction once engaged. However, the forward action of the lift motor 168 occurs only when the lift motor contactor 166 is configured with the forward contacts 166E–166A and 166F–166C are closed. The lift motor 168 will reverse when the reverse contacts 166E–166B and 166F–166D close.

The take off pump contactor 172 and the take off pump motor 174 combination is also connected to the voltage source through the circuit breaker 162, with the take off pump motor being grounded 176. The take off pump 174 is engaged when the take off pump contactor 172 is engaged.

A 200 volt-amp transformer 178 is also connected to the voltage source through the circuit breaker 162. The transformer 178 is wired to operate with a high voltage and to produce an output of 110 volts. The transformer 178 has two output lines, labeled T1 and T2 for clarity. Connected across the transformer 178 output lines is a two-amp maximum load ground fault interrupt (GFI) 180. Also connected across the transformer 178 output is a twenty-four hour TR1 timer 182.

The GFI 180 allows the system operator to connect conventional equipment to the power source for use at the well site. The twenty-four TR1 timer 182 allows an operator to program the system to operate at specified parameters during a twenty-four hour period. Because power is always on the TR1 timer 182 when the circuit is closed, the TR1 timer 182 is programmable and may be set to initiate an activity at fifteen minute intervals. When the TR1 timer 182 reaches a specified preset, contacts within the circuit dose and provide power to designated circuit elements. For example, the system operator may project that the well will be emptied after a certain number of operating hours. To allow the well to refill, from seepage or from some other method, the system may be programmed to turn off at the projected time.

Two two-set fuses 184 and 186 of appropriate amperage, preferably fifteen amps, span the transformer output lines. A TR7 reset timer 188 spans the T1 and T2 lines between the fuses 184 and 186 and a TR7 contact 190. The preferred TR7 reset timer 188 is a solid state square timer that will engage the control system and ultimately the lift motor 168 after it times out. It is used to restart the system after a predetermined period, such as ten minutes. An event such as a power failure or system failure could trigger the timer so that the system may be restarted. Thus the TR7 reset timer 188 acts as a delay before the system is restarted. This delay allows the dipping assembly 28 (FIG. 1) to be lowered completely into the well liquid before the system is initialized and engaged, thereby allowing the dipping assembly 28 time to be filled with liquid before being raised.

When the TR7 timer 188 times out, it allows the TR7 contact 190 to close. Then, the system may be started by engaging the power switch 192 which is connected between the TR7 contact 190 and the control circuit 194. Once the power switch 192 is engaged, all signals transfer to the control circuit 194 of FIG. 11.

FIG. 11 exhibits the control circuit 194 of the system with a functional schematic. The system may operate in one of three modes: manual, semi-automatic, or automatic. Manual mode is initiated when the JOG switch 196 is closed. By utilizing this mode, the dipping assembly 28 (FIG. 1) may be raised from a well by manual operation. When the dipping assembly 28 has been raised to a required height, the operator may engage a slide block pulley brake 56 (FIG. 4) to stop the dipping assembly from raising or lowering. The semi-automatic cycle, which is similar in action to the automatic cycle described hereinafter, may be initiated by pressing the single cycle switch 208. Thereafter, the cycle start switch 246 initiates the forward action and the cycle reverse switch 270 initiates the reverse cycle. Finally, full automatic action may be initiated by pressing the full automatic switch 218.

Among the elements of the circuit, there are several control relays, each marked as CR (Control Relay) with an alpha character. For example, CRA 214, CRB 240, CRC 230, CRD 286, CRE 254, and CRF 276 are all relays. The function of each of the relays is to act as a latch. Each relay is a single pole, double throw relay which has four sets of contacts. Each contact is designated by an incremental number. Thus, the four CRA contacts are designated as CRA-1 202, CRA-2 216, CRA-3 248, and CRA-4 272, respectively. When the relay is pulled in, i.e. energized, it energizes each of the contacts, thereby opening a normally closed (NC) contact, and closing a normally open (NO) contact. For example, when CRA 214 is pulled in, all of the CRA relay contacts are energized. This would pull in the CRA contacts, such as the NO CRA-2 contact 216, and keep the power circuit closed until another relay which would open the circuit, such as the CRB relay 240, is energized The system contains a full automatic switch 218 comprising a three pole, single throw toggle switch. All contacts are made when the switch is thrown, thereby starting the full automatic cycle. However, the automatic mode will only commence if the twenty-four hour TR1 timer 158 (FIG. 9) or 182 (FIG. 10) has timed out to its preset, closing the TR1 contact 228. When the TR1 contact 228 is closed, the CRC relay 230 is powered, and the CRC contacts 220, 224 and 238 are engaged. A closed circuit is then provided when the full automatic switch 218 is closed. That closure simultaneously pulls the CRB relay 240 and energizes the TR3 timer 222.

When the CRB relay 240 is pulled in, the CRB contacts 200, 212, 242 and 288 are energized. When the CRB-1 contact 200 closes, the motor 198 is energized and it starts, thereby raising the dipping assembly 28 of FIG. 1. As the dipping assembly 28 is being raised, the TR3 timer 222 is timing out. Preferably, the TR3 timer 222 is set for five seconds.

When the TR3 timer 222 times out, the TR3 contact 226 opens. This opening function occurs only once during the automatic cycle. The opening function is used to initialize the circuit elements, open the circuit path, and energize the CRB relay 240 as if the cycle start switch 246 had been activated. After the TR3 timer 222 times out and opens the TR3 contact 226, the system continues on automatic and the twenty-four hour TR1 timer 158 or 182 controls all action.

The system is kept running because the CRB-3 contact 242 had also been energized when the CRB relay 240 was energized, thereby acting as a latch to provide an alternate path to close the circuit. By providing this path, the circuit has a NC limit switch contact 244 shutoff which may later open the circuit. The limit switch contact 244 is opened when the dipping cups 30 (FIG. 1) from the dipping assembly 28 contact the physical limit switch 80 (FIG. 2 and FIG. 3), eventually causing the system to stop raising the dipping assembly 28.

When the NC limit switch contact 244 opens, it opens the circuit path to the CRB relay 240. The power to the CRB relay 240 is cut and the CRB relay 240 contacts are de-energized. Therefore, CRB-2 212 and CRB-4 288 return to their normally dosed position, while CRB-1 200 and CRB-2 242 return to their normally open position. This type of reaction occurs in an analogous manner for all relays and their contacts when power is removed from them.

At the same time that the NC limit switch contact 244 opens, the NO limit switch contact 210 closes, creating a circuit path to the CRA relay 214 and energizing it. As the CRA relay 214 is pulled in, the CRA contacts 202, 216, 248 and 272 are energized. The NC CRA-1 contact 202 opens, and power is pulled from the motor 198. In addition, CRA-4 248 closes, energizing the TR6 timer 274 and pulling in the CRF relay 276.

The CRF-1 contact 278 is energized, providing power to the lift motor contactor 282 and 204 and the motor 198. At the same time, the TR6 timer 274 begins to time out. This TR6 time out period gives the dipping cups 30 a chance to be pulled up and over the guide wheel 48 (FIG. 3) so that the dipping cups 30 may be emptied. When the TR6 timer 274 times out, it opens the NC TR6 contact 280, killing power to the lift motor contactor 282 and 204 of the motor 198.

As stated, the TR6 timer 274 and delay are incorporated into the limit switch function 80 to provide the dipping cups 30 (FIG. 3) time to empty. As the dipping assembly 28 is pulled up and wound on the spool 46 (FIG. 3), the thickness of the rope on the spool 46 increases. As that thickness increases, the speed of the revolving spool 46 stays the same, but the speed at which the rope is raised increases. Thus, the TR6 timer 274 is preset to take this factor into account. If there was no timer, the dipping cups 30 would not be in the correct location for emptying at the proper time.

The TR6 timer 274 has another function, related to the single phase motor. The single phase motor must come to a complete stop in order to change directions. If there is an attempt to activate the motor 136 before it has come to a complete stop, even if the wire pairs have had a chance to switch to reverse mode, then the motor 136 will run in the same direction as before. For example, if the motor is lowering the dipping assembly 28, and there is an attempt to change direction without allowing the motor 136 to stop, then the motor 136 will keep running in the same direction and wind the spool 46 in the wrong direction.

The TR4 timer 250 controls when the motor 136 is actually engaged in the reverse direction. Therefore, as a precaution, the preset time for the TR4 timer 250 should be greater than the preset time of the TR6 timer 274. Otherwise, the motor 136 will come on while the system is attempting to park the dipping assembly 28, resulting in the motor 136 being signaled to raise the dipping assembly 28 at the same time it is being signaled to lower the dipping assembly 28. Note that the three phase motor 168 does not experience these problems because it can change directions while running.

In addition to closing the CRA-4 contact 272, the CRA relay 214 closes the CRA-3 contact 248, allowing the TR4 timer 250 to be energized. The TR4 timer 250 times out and closes the TR4 contact 252, thereby pulling in the CRE relay 254.

The CRE relay 254 energizes its CRE-3 contact 266, starting the lift motor reverse 268. Simultaneously, the CRE-1 contact 256 closes, activating the TR5 timer 258 and closing the circuit through the now closed CRE-2 contact 262. When the CRE-1 256 and CRE-2 262 contacts close, power is provided to the lift motor contactor 264 and 206, and the motor operates in the reverse direction.

The TR5 timer 258 is unique in that it has four sets of contacts. In contrast, the TR1 timer 158 and 182 is a twenty-four hour single switch timer, much like a coffee pot timer. The other timers are solid state.

The TR5 timer 258 is also programmable. It controls the amount of time the motor is run in reverse. This amount must be long enough to allow the dipping assembly 28 to be lowered into the liquid.

When the TR5 timer 258 times out, it opens the "XXO" TR5 contact 260, which opens the circuit to the lift motor contactor 264 and 206. The TR5 timer 258 closes the "OOX" TR5 contact 284, providing power to the CRD relay 286.

When the CRD relay 286 is pulled, the cup fall timer, TR2 234, is started. The CRD relay 286 closes the CRD-2 contact 290 and the CRD-1 contact 232, allowing the TR2 timer 234 to be energized. When the TR2 timer 234 times out, it closes the TR2 contact 236 which closes the circuit path to the CRB relay 240.

Powering the CRB relay 240 operates to recycle the system. The CRB relay 240 energizes each of its contacts 200, 212, 242 and 288. By this point, the NC limit switch 244 has been reset to its closed position because the dipping assembly 28 has been lowered. CRB-3 242 closes to provide a continuous path to the CRB relay 240.

As the CRB-4 contact 288 opens, it cuts power from the CRD relay 286. As the CRB-2 contact 212 opens, it cuts power from the CRA relay 214. When the CRA relay 214 is de-energized, contact CRA-1 202 closes and power is provided to the motor. In addition, the CRA relay 214 contacts CRA-2 216, CRA-3 248, and CRA-4 272 all open. The end result of this action is that all relays and timing circuits, except CRB 240, are de-energized. Since the CRB relay 240 remains energized at this point, the cycle repeats.

The operation of the holding tank pump is considerably easier. When the float switch 292 rises to a predetermined level, it creates a closed condition. At that point the pump motor 294 engages. Alternatively, an operator may push a pump switch 296 to engage the pump motor 294. The pump motor 294 will disengage when either the float switch 292 is lowered or when the pump switch 296 is opened.

The use of the apparatus 14 requires assembly of the apparatus 14 as described. First, of course, a specific well is selected and the production parameters are identified. The size and number of the dipping cups 30, as well as the frequency of the dipping cycles, will vary depending on the anticipated production rate of the well. The depth of the water level is determined according to known procedures, and the length of the dipping string 32 is selected accordingly. The various timers in the electrical system are set as desired. The apparatus 14 is positioned over the well head 18 with the cylindrical collar 60 at the bottom of the housing 36 aligned therewith. The dipping string 32 is plumbed by adjusting the legs 64 of the frame 34. Having installed the apparatus 14 properly, manual operation of the apparatus 14 may be initiated by operation of the manual switch 42 (FIG. 4), and several dipping cycles are observed until the operator is satisfied that the apparatus is functioning properly. Then, automatic operation is initiated by the automatic switch 41 (FIG. 4). Thereafter, the apparatus 14 should be monitored appropriately.

In accordance with the method of the present invention, preferably utilizing the apparatus 14, a dipping assembly 28 is repeatedly and automatically extended into and retracted out of a column of oil 24 in the well bore 20. This dipping step is carded out from a position over the well bore 20, and more specifically at the well head 18, and is completed without the use of a sucker rod or tubing string. The dipping assembly 28 comprises at least one and preferably a plurality of dipping cups 30 axially supported on a dipping string 32. In each cycle, oil is collected from the dipping cups 30 by inverting the dipping cups 30 over a collection chamber 58 after the retraction and before the extension of the dipping assembly 28. Preferably, the dipping cycle is carried out by a motorized pulley system as previously described. Even more preferably, the dipping cups 30 utilized to perform this method are formed and assembled as previously described, and the dipping assembly 28 includes a leader cone at each end 114 and 116.

Changes may be made in the combination and arrangement of the various parts, elements, steps and procedures described herein without departing from the spirit and scope of the invention as defined in the following claims.

What is claimed is:

1. A portable apparatus for lifting liquid from a column of liquid in an underground well bore which opens above ground, the apparatus comprising:

a frame adapted to support the apparatus over the well bore;

a pulley system supported on the flame, wherein the pulley system comprises:

a spool;

a guide wheel supported proximate to the spool;

a dipping string having one end attached to the spool of the pulley system and one free end, a portion of the string therebetween supported over the guide wheel, the length of the dipping string being sufficient to extend from the spool, over the guide wheel and down into a column of liquid when the apparatus is positioned over the well bore;

a weight on the free end of the dipping string; and a motorized drive assembly adapted to turn the spool;

a dipping assembly supported on the dipping string of the pulley system, the dipping assembly comprising a dipping cup having a closed lower end and an open upper end, the dipping cup being axially supported on the dipping string; and wherein the spool, the guide wheel and the dipping assembly are arranged so that the dipping cup is inverted as the dipping cup is pulled over the guide wheel toward the spool and so that the dipping cup is returned to an upright position as the dipping cup is pulled over the guide wheel toward the well bore;

an electrical system adapted to permit operation of the apparatus;

a collection chamber positioned to receive liquid from the dipping cup as it is inverted; and a discharge port extending from the collection chamber for draining liquid therefrom.

2. The apparatus of claim 1 wherein the motorized drive assembly is adapted to retract the dipping string from the well bore.

3. The apparatus of claim 1 wherein the motorized drive assembly is adapted to release the spool to allow the weight on the free end of the dipping string to extend the dipping string down into the well bore.

4. The apparatus of claim 1 wherein the motorized drive assembly is adapted to operate in a reverse direction and lower the dipping string down into the well bore at a controlled speed.

5. The apparatus of claim 1 further comprising a clutch assembly to control speeds at which the dipping string descends down into the well bore.

6. The apparatus of claim 1 further comprising a housing for enclosing the pulley system.

7. The apparatus of claim 1 further comprising a cover for enclosing the motorized drive assembly.

8. The apparatus of claim 1 wherein the electrical system permits automatic operation of the apparatus.

9. The apparatus of claim 1 wherein the electrical system permits manual operation of the apparatus.

10. The apparatus of claim 1 wherein the electrical system includes timer circuits for automatic intermittent operation of the apparatus.

11. The apparatus of claim 1 wherein the dipping assembly further comprises a leader cone on each end of the dipping assembly.

12. The apparatus of claim 11 wherein the dipping assembly further comprises a plurality of dipping cups.

13. The apparatus of claim 1 wherein the dipping assembly further comprises a plurality of dipping cups.

14. The apparatus of claim 1 wherein the dipping cup comprises:

a body having a closed lower end and an open upper end, and having a generally cylindrical side wall with an inner surface, the inner surface defining a liquid-receiving space, the body further comprising an axial tube extending a distance up from the closed lower end inside the body, the axial tube being sized to receive the dipping string; and a lid sized to cover the open upper end of the body, the lid having a central opening therein aligned with the robe in the body and sized to receive the dipping string, the lid further having at least one opening communicating with the liquid-receiving space in the body, the lid comprising:

a peripheral flange sized to extend slightly beyond the body when the lid is positioned over the open upper end of the body; and a plurality of fingers depending from the lid near the peripheral flange, the fingers sized to extend down into the body and positioned on the lid so that when the lid is positioned over the open upper end of the body the fingers will be adjacent the inner surface of the side wall.

15. The apparatus of claim 14 wherein the dipping assembly further comprises a plurality of dipping cups.

16. The apparatus of claim 15 wherein the dipping assembly further comprises a leader cone on each end of the dipping assembly.

17. The apparatus of claim 14 wherein the axial robe in the body of the dipping cup extends the length of the body.

18. The apparatus of claim 1 wherein the frame is supported on a plurality of adjustable supports.

19. A portable apparatus for recovering oil from a non-pressurized well having a well bore opening above ground, the apparatus comprising:

a pulley system comprising:

a spool;

a guide wheel supported proximate to the spool;

a dipping string having one end attached to the spool of the pulley system and one free end, a portion of the string therebetween supported over the guide wheel, the length of the dipping string being sufficient to extend from the spool, over the guide wheel and down into a column of liquid when the apparatus is positioned over the well bore;

a weight on the free end of the dipping string; and a motorized drive assembly for turning the spool;

a frame on which the pulley assembly is mounted, the frame supported on a plurality of independently adjustable legs;

a dipping assembly supported on the dipping string of the pulley system, the dipping assembly comprising a plurality of dipping cups, each dipping cup having a closed lower end and an open upper end and being axially supported on the dipping string near the free end;

wherein the spool, the guide wheel, the dipping string and the dipping assembly are arranged so that the dipping cups are inverted as they are pulled over the guide wheel toward the spool and so that the dipping cups are returned to an upright position as they are pulled over the guide wheel toward the well bore;

an electrical system adapted to permit operation of the apparatus;

a collection chamber collecting oil from the dipping cups as they are inverted; and a discharge port extending from the collection chamber for draining oil therefrom.

20. The apparatus of claim 19 wherein the motorized drive assembly is adapted to retract the dipping string.

21. The apparatus of claim 19 wherein the motorized drive assembly is adapted to release the spool to allow the weight to extend the string by pulling the free end of the dipping string down into the well bore.

22. The apparatus of claim 19 wherein the motorized drive assembly is adapted to operate in a reverse direction and lower the dipping string down into the well bore at a controlled speed.

23. The apparatus of claim 19 further comprising a clutch assembly to control speeds at which the dipping string descends down into the well bore.

24. The apparatus of claim 19 further comprising a housing for enclosing the pulley system.

25. The apparatus of claim 19 further comprising a cover for enclosing the motorized drive assembly.

26. The apparatus of claim 19 wherein the electrical system permits automatic operation of the apparatus.

27. The apparatus of claim 19 wherein the electrical system permits manual operation of the apparatus.

28. The apparatus of claim 19 wherein the electrical system includes timer circuits for automatic intermittent operation of the apparatus.

29. The apparatus of claim 19 wherein the dipping assembly comprises a leader cone on each end of the dipping assembly.

30. The apparatus of claim 19 wherein each of the plurality of dipping cups comprises:

a body comprising a dosed lower end and an open upper end, and a generally cylindrical side wall with an inner surface, the inner surface defining a liquid-receiving space, the body further comprising an axial tube extending a distance up from the bottom inside the body, the axial tube being sized to receive the dipping string; and a lid sized to cover the open upper end of the body, the lid having a central opening therein aligned with the tube in the body portion and sized to receive the dipping string, the lid having at least one opening communicating with the liquid-receiving space in the body, and the lid comprising:

a peripheral flange sized to extend slightly beyond the body when the lid is positioned over the open upper end of the body; and a plurality of fingers depending from the lid near the peripheral flange, the fingers sized to extend down into the body and positioned on the lid so that when the lid is positioned over the open upper end of the body the fingers will be adjacent the inner surface of the side wall.

31. The apparatus of claim 30 wherein the dipping assembly comprises a leader cone on each end of the dipping assembly, each leader cone being adapted to guide the dipping assembly into the well head.

32. The apparatus of claim 30 wherein the axial tube in the body of the dipping cups extend the length of the body.

33. A method for recovering oil from a column of oil in the well bore of a non-pressurized well, the method comprising:

repeatedly and automatically extending and retracting a dipping assembly directly into and out of the column of oil in the well bore from a position over the well bore without the use of a sucker rod or tubing string, wherein the dipping assembly comprises a plurality of dipping cups axially supported on a dipping string; and after retracting the plurality of dipping cups out of the well bore and before extending the plurality of dipping cups into the well bore, collecting oil from the dipping cups by inverting the dipping cups over a collection chamber.

34. The method of claim 33 wherein the step of extending and retracting the dipping assembly is carried out by motorized a pulley system.

35. The method of claim 34 wherein the pulley system comprises a guide wheel supported proximate to a spool on which the dipping string is wound, and wherein the guide wheel, the spool, and the dipping assembly are adapted to invert the dipping cups as the dipping cups are pulled over the guide wheel toward the spool and to return the dipping cups to an upright position as the dipping cups are pulled aver the guide wheel toward the well bore.

36. The method of claim 33 wherein each of the plurality of dipping cups comprises:

a body comprising a closed lower end and an open upper end, and having a generally cylindrical side wall with an inner surface, the inner surface defining a liquid-receiving space, the body further comprising an axial tube extending a distance up from the bottom inside the body, the axial tube being sized to receive the dipping string; and a lid sized to cover the open upper end of the body, the lid having a central opening therein aligned with the tube in the body and sized to receive the dipping string, and further having at least one opening communicating with the liquid-receiving space in the body, the lid comprising:

a peripheral flange sized to extend slightly beyond the body when the lid is positioned over the open upper end of the body; and a plurality of fingers depending from the lid near the peripheral flange, the fingers sized to extend down into the body and positioned on the lid so that when the lid is positioned over the open upper end of the body the fingers will be adjacent the inner surface of the side wall.

37. The method of claim 36 wherein the dipping assembly comprises a leader cone on each end of the dipping assembly.

* * * * *